US009669559B2

(12) United States Patent
Cao

(10) Patent No.: US 9,669,559 B2
(45) Date of Patent: Jun. 6, 2017

(54) PUNCHING DEVICE FOR PUNCHING NETWORK NODES ON MOLD INSERT AND METHOD OF PUNCHING NETWORK NODES USING THE SAME

(71) Applicants: BOE TECHNOLOGY GROUP CO., LTD., Beijing (CN); BOE Optical Science and technology Co., Ltd., Suzhou (CN)

(72) Inventor: Chunlei Cao, Beijing (CN)

(73) Assignees: BOE TECHNOLOGY GROUP CO., LTD., Beijing (CN); BOE OPTICAL SCIENCE AND TECHNOLOGY CO., LTD., Suzhou (CN)

( * ) Notice: Subject to any disclaimer, the term of this patent is extended or adjusted under 35 U.S.C. 154(b) by 321 days.

(21) Appl. No.: 14/335,331

(22) Filed: Jul. 18, 2014

(65) Prior Publication Data

US 2015/0251329 A1 Sep. 10, 2015

(30) Foreign Application Priority Data

Mar. 6, 2014 (CN) ..... 2014 1 0080736

(51) Int. Cl.

| | |
|---|---|
| ***B26F 1/02*** | (2006.01) |
| ***B26D 5/08*** | (2006.01) |
| ***B26D 5/00*** | (2006.01) |
| ***B26D 7/28*** | (2006.01) |
| ***B26F 1/24*** | (2006.01) |

(52) U.S. Cl.

CPC ..... *B26D 5/086* (2013.01); *B26D 5/007* (2013.01); *B26D 7/28* (2013.01); *B26F 1/02* (2013.01); *B26F 1/24* (2013.01); *Y10T 83/02* (2015.04); *Y10T 83/04* (2015.04); *Y10T 83/178* (2015.04); *Y10T 83/87* (2015.04)

(58) Field of Classification Search

CPC ..... B26F 1/24; B26D 5/086
USPC ..... 83/660, 575–577, 530
See application file for complete search history.

(56) References Cited

U.S. PATENT DOCUMENTS 2,509,956 A * 5/1950 Benoit ..... B21D 28/002 192/131 R
4,306,356 A * 12/1981 Buscher ..... B26D 5/08 30/362
5,269,213 A * 12/1993 Coneski ..... B21D 28/002 83/577

(Continued)

*Primary Examiner* — Kenneth E Peterson
(74) *Attorney, Agent, or Firm* — Kinney & Lange, P.A.

(57) ABSTRACT

The present disclosure relates to a punching device for punching network nodes on a mold insert, comprising: a first horizontal guide rail, a mounting seat, a first driver, a punching mechanism, a laser distance meter, a host computer, a displacement operation controller, and a work platform, wherein the laser distance meter is configured to measure at least one of thicknesses and hole diameters, spacing between the network nodes, and flatness of the mold insert, the displacement operation controller derives an appropriate value of electrical current from measurement results of the laser distance meter and sends it to the host computer, and the host computer supplies electricity to the electromagnetic mechanism in accordance with the value of electrical current, so as to perform an operation of punching the network nodes. In addition, it also relates to a method of punching network nodes on a mold insert using a punching device.

19 Claims, 2 Drawing Sheets

(56) References Cited

U.S. PATENT DOCUMENTS

| | | | | |
|---|---|---|---|---|
| 6,152,003 | A * | 11/2000 | Jung | B26D 7/20 83/74 |
| 9,126,559 | B2 * | 9/2015 | Ito | B60R 21/2165 |
| 2005/0000337 | A1 * | 1/2005 | Ahne | B26D 5/08 83/76.1 |

* cited by examiner

PUNCHING DEVICE FOR PUNCHING NETWORK NODES ON MOLD INSERT AND METHOD OF PUNCHING NETWORK NODES USING THE SAME

CROSS-REFERENCE TO RELATED APPLICATION

This application claims the benefit of Chinese Patent Application No. 201410080736.4 filed on Mar. 6, 2014 in the State Intellectual Property Office of China, the whole disclosure of which is incorporated herein by reference.

BACKGROUND OF THE INVENTION

Field of the Invention

The present disclosure relates to a technical field of punching technique, more particularly, to a punching device for punching network nodes on a mold insert and a method of punching network nodes by using the same.

Description of the Related Art

Thin film transistor liquid crystal display (TFT-LCD) technique has become very mature, and is applied from a small size screen of mobile phone to a large size screen of television.

A backlight module of a LCD panel includes a light source, a reflection plate, a light guide plate, a diffusion plate, a prism sheet and an optical sheet, or the like. Major techniques of the LCD panel are focused on optical design of the liquid guide plate, mold design and manufacturing, and precision injection molding technology. One of the most crucial requirements for the light guide plate is to improve brilliance and to evenly distribute light rays. Therefore, property of the light guide plate is directly correlated to a yield of the entire backlight module.

Currently, mainstream technologies of the light guide plate include a printing technique and a non-printing technique, wherein the former is to evenly distribute printing materials of high light scattering substance onto a bottom surface of the light guide plate, while the latter is to form V-shaped microgrooves by using a precision mold insert, and then to manufacture the light guide plate complying with optical characteristics by means of a manufacturing mode of injection molding.

High precision light guide plate requires accurate V-shaped grooves having an identical depth, an identical pitch between adjacent grooves, and smooth surfaces of the V-shaped grooves, and so on.

One existing technique employs driving a tool bit with air pressure and injecting it onto the mold insert, so as to form cavities (i.e., network node). It is not easy to adjust the air pressure, so that hole diameters of the formed cavities and tolerance of their depths would dramatically change. This has a relatively large effect on the yield of the light guide plate. In addition, the spacing of the bit and the mold insert cannot be adjusted, and thus this demands the surface of the mold insert has a relatively high flatness. Slight change of the surface height will produce a relatively large effect on the depth of the network nodes.

SUMMARY OF THE INVENTION

In order to eliminate the above or other technical problems in the prior art, the present disclosure provides a punching device for punching network nodes on a mold insert, which at least solves the technical problem that a punching force of the existing punching device for mold insert is not easy to adjust, resulting in large change of the hole diameters of the network nodes and the depth tolerance.

In accordance with one aspect of the present invention, it provides a punching device for punching network nodes on a mold insert, comprising:

a first horizontal guide rail;

a mounting seat, installed on the first horizontal guide rail and horizontally movable along the first horizontal guide rail;

a first driver, installed on the first horizontal guide rail and connected with the mounting seat by a first driving mechanism;

a punching mechanism, installed on the mounting seat;

a laser distance meter, installed on the mounting seat;

a host computer, electrically connected with both the punching mechanism and the first driver;

a displacement operation controller, communicated with both the laser distance meter and the host computer; and a work platform, for carrying the mold insert and located beneath the punching mechanism, wherein the laser distance meter is configured to measure at least one of depth and hole diameters of the formed network nodes, spacing between the network nodes, and flatness of the mold insert, and the displacement operation controller derives an appropriate value of electrical current from measurement results of the laser distance meter and sends the value of electrical current to the host computer, and the host computer supplies electricity to the electromagnetic mechanism in accordance with the value of electrical current, so as to perform an operation of punching the network nodes on the mold insert.

In accordance with another aspect of the present invention, it provides a method of punching network nodes on a mold insert using a punching device according to claim 1, comprising the following steps:

S1: placing the mold insert on a work platform of the punching device;

S2: setting a value of electrical current supplied to an electromagnetic mechanism within a punching mechanism in accordance with depths of network nodes and hole diameters thereof;

S3: starting the punching mechanism, and sending the set value of the electrical current to the electromagnetic mechanism by a host computer, so that the electromagnetic mechanism generates a corresponding repulsive force, and under the action of such repulsive force, the plunger within the punching mechanism is pushed and in turn it pushes a tool bit so as to perform a network node punching operation;

S4: performing measurement by means of a laser distance meter during the network node punching operation, and using a displacement operation controller to calculate a tolerance value of displacement from measurement results of the laser distance meter and converting it into a tolerance value of the electrical current, and adjusting a value of the electrical current supplied to the electromagnetic mechanism by means of the host computer in accordance with the tolerance value of the electrical current;

S5: during the punching process of the network nodes on the mold insert, controlling the first driver by the host computer so as to drive the mounting seat and horizontally move it along the first horizontal guide rail in a first direction, so that the tool bit horizontally moves in the first direction; and controlling the second driver so as to drive the work platform and horizontally move it along the second horizontal guide rail in a second direction perpendicular to the first direction, so that the mold insert horizontally moves in the second direction, thereby performing the punching operations of the plurality of network nodes on the surface of the mold insert.

BRIEF DESCRIPTION OF THE DRAWINGS

The above and other features of the present invention will become more apparent by describing in detail exemplary embodiments thereof with reference to the accompanying drawings, in which:

FIG. 4 is a control principle view of a punching process of the present invention.

LIST OF REFERENCE NUMBERS

Figure 1:
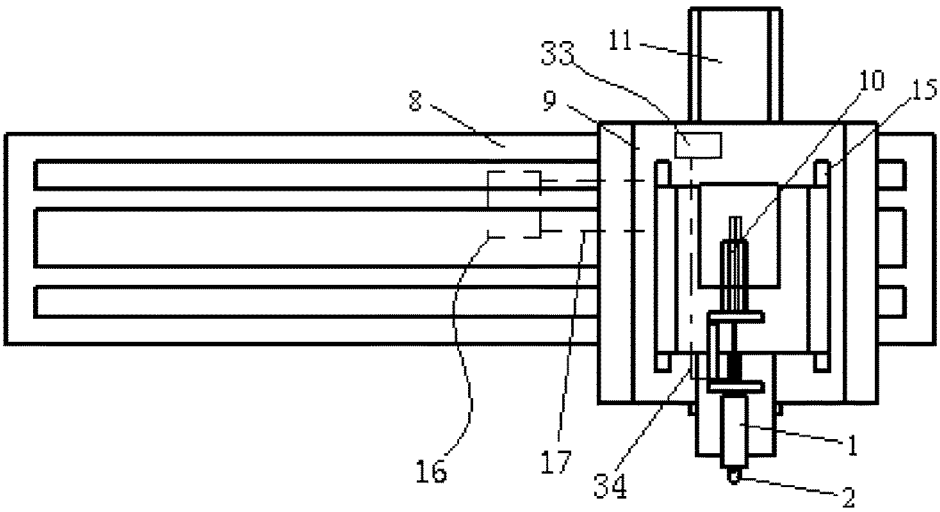
FIG. 1 is a schematic view showing a structure of a punching device for punching network nodes on a mold insert, in accordance with an embodiment of the present invention.

1—housing
1*a*—an upper portion of the housing
1*b*—a lower portion of the housing
2—tool bit
3—plunger
4—electromagnetic mechanism
4*a*—an upper part of electromagnetic mechanism
4*b*—a lower part of electromagnetic mechanism
5—return spring
6—cable
7—connecting joint
8—first horizontal guide rail
9—mounting seat
10—fine adjustment knob
11—laser distance meter
12—work platform
13—second horizontal guide rail
14—stop
15 vertical guide rail

DETAILED DESCRIPTION OF PREFERRED EMBODIMENTS OF THE INVENTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Specific embodiments of the present invention will be described in detail with reference to the accompanying drawings. The following embodiments are used to explain the present invention, but not limiting to the scope of the present invention.

Figure 3:
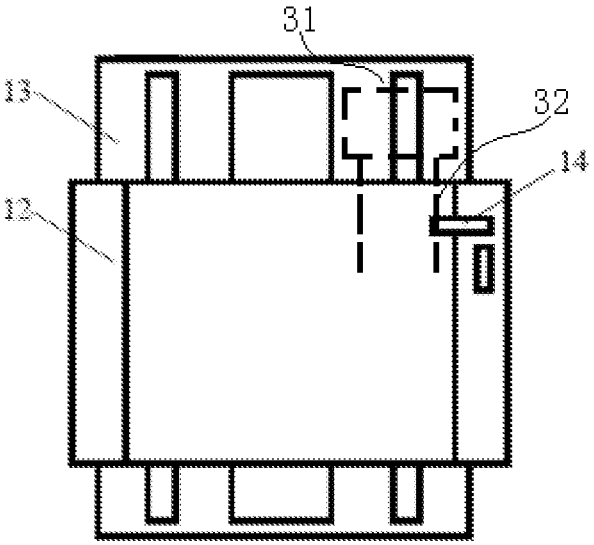
FIG. 3 is a schematic view showing a structure of a work platform in accordance with one embodiment of the present invention.

As shown in FIGS. 1 and 3, a punching device for punching network nodes on a mold insert in accordance with an embodiment of the present invention includes a punching mechanism, a mounting seat 9, a first driver 16, a first horizontal guide rail 8, a laser distance meter 11, a displacement operation controller, a host computer and a work platform 12. The work platform 12 is located beneath the tool bit 2. Both the punching mechanism and the laser distance meter 11 are fixed on the mounting seat 9, which is installed on the first horizontal guide rail 8 and is capable of horizontally moving along the first horizontal guide rail 8 in a X direction. During the horizontal movement of the mounting seat 9, the punching mechanism and the laser distance meter 11 also horizontally move along with the mounting seat 9. The first driver 16 is installed on the first horizontal guide rail 8 and is connected with the mounting seat 9 by a first driving mechanism 17. The displacement operation controller is communicated with both the laser distance meter 11 and the host computer, and the host computer is electrically connected with both the punching mechanism and the first driver 16, in order to supply electricity to the punching mechanism.

Figure 1A:
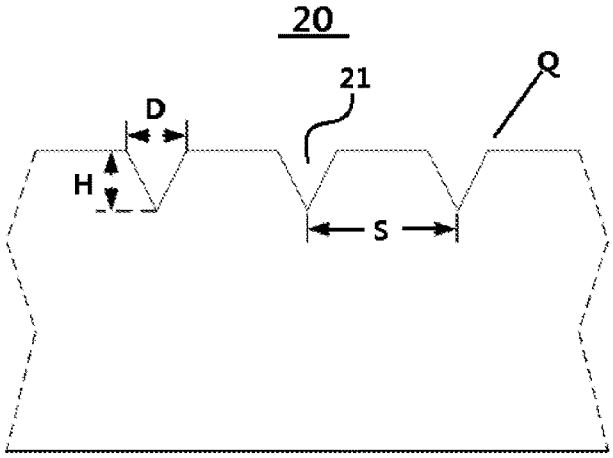
FIG. 1*a* is a view showing a structure of a mold insert.

A triangulation technique is used by the laser distance meter 11, to measure depths and hole diameters of the formed network nodes on the mold insert, spacing between adjacent network nodes, and flatness of the mold insert. It should be noted that the laser distance meter 11 can only measure at least one of the thicknesses H and hole diameters D of the formed network nodes 21, spacing S between adjacent network nodes 21, and flatness Q of the mold insert 20 (as shown in FIG. 1*a*). The displacement operation controller converts measurement results such as displacement information fed back from the laser distance meter 11 into a suitable value of electrical current, and sends it to the host computer. Then, the host computer transmits it into the punching mechanism to perform a dotting operation or a network node punching operation in accordance with the calculated value of electrical current. The present invention accurately measures in real-time the depth of the network node, the hole diameter, the flatness of the surface of the mold insert and the spacing between adjacent network nodes by means of the laser distance meter. In this way, it is possible to adjust in real-time the punching force of the network node outputted from the punching mechanism and the movement position of the punching mechanism during the punching process. Therefore, the hole diameter and the depth of the network node and the uniformity thereof are accurately controlled, and further the tolerance of the depth and the hole diameter of the network node can be reduced and the yield of the light guide plate can be improved.

Figure 2:
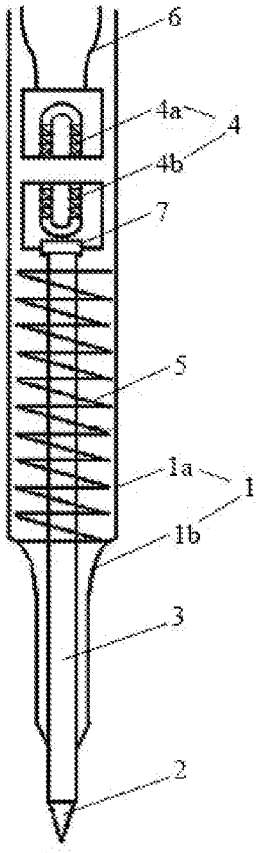
FIG. 2 is a schematic view showing a structure of a punching mechanism as shown in FIG. 1.

As shown in FIG. 2, the punching mechanism in an embodiment of the present invention, includes a housing 1, and a tool bit 2, a plunger 3, a return spring 5 and an electromagnetic mechanism 4 which are in turn provided within an interior of the housing 1 (i.e., from bottom to top in FIG. 2). The housing 1 is fixedly mounted on the mounting seat 9. The host computer is electrically connected with the electromagnetic mechanism 4 via a cable 6, in order to control on-off of the electromagnetic mechanism 4 and magnetic force thereof. The electromagnetic mechanism 4 is connected to an upper end of the plunger 3, for applying a pushing force to the plunger 3. The return spring 5 is installed on the exterior of the plunger 3 and surrounds the plunger 3. An upper end of the return spring 5 is fixed to the upper end of the plunger 3, and a lower end of the return spring 5 is abutted against a lower portion 1*b* of the housing, so that the return spring 5 is stuck into the interior of the housing 1 and thus the plunger 3 would not be disengaged from the interior of the housing 1. The return spring 5 has the function of automatically restoring the plunger 3 after the punching operation. A lower end of the plunger 3 is connected to the tool bit 2, and the work platform 12 is used to carry the mold insert, which is located beneath the tool bit 2. In one example, the tool bit 2 is a diamond bit, which has higher hardness, and thus can prolong the lifetime thereof.

When the power source is switched on, the electromagnetic mechanism 4 is supplied with electricity to generate the magnetic force for pushing the plunger 3. The plunger 3 pushes the tool bit 2 downwardly, so as to punch the mold insert and to form the desired cavities (i.e., the network nodes). After the punching of the cavity, under the action of the return spring 5, the bit 2 is restored by the driving of the plunger 3, in order to perform next punching of another cavity. During the punching process, a value of the electrical current supplied to the electromagnetic mechanism 4 (the electricity supplied to the electromagnetic mechanism 4) is adjusted by the host computer as required and in accordance with the practical condition. Further, the magnetic force generated by the electromagnetic mechanism 4 can be adjusted, thereby obtaining the desired hole diameter and the depth of the cavity, reducing the tolerance of the depth, and improving the yield of the light guide plate.

The upper portion 1*a* of the housing has a larger diameter than that of the lower portion 1*b* of the housing, which produces the following effects: on one hand, positioning of the return spring 5; and on the other hand, the punching action of the plunger 3 is guided due to the less diameter of the lower portion 1*b*, in order to avoid colliding of the plunger 3 with the housing 1 caused by a shifting movement thereof.

The electromagnetic mechanism 4 includes an upper part 4*a* of the electromagnetic mechanism and a lower part 4*b* of the electromagnetic mechanism, wherein the upper part 4*a* is connected with the host computer via the cable 6, and the lower part 4*b* is connected with the upper end of the plunger 3. Herein, both the upper part 4*a* and the lower part 4*b* are made of electromagnet and windings wound around an exterior of the electromagnet. When the power source is switched on, the upper part 4*a* and the lower part 4*b* of the electromagnetic mechanism generate repulsive force therebetween. Such repulsive force pushes the plunger 3 and then in turn the tool bit 2 downwardly, so as to punch the mold insert for forming the desired network nodes. As used herein, the electromagnetic mechanism is used as a drive mechanism for performing the punching operation. During the punching process, the voltage of the power source can be adjusted as desired and in accordance with the actual condition, and the magnetic force of the electromagnetic mechanism can be adjusted as well, thereby improving controllability and punching accuracy of the overall punching mechanism.

The housing 1 is made of diamagnetic materials having low friction coefficient, and would not have any effect on the magnetic field of the electromagnetic mechanism 4. Furthermore, there is a small friction force between the plunger 3 and the housing 1 during the movement of the plunger 3, because when the plunger 3 is performing the punching operation, the plunger 3 is likely to slightly collide with the lower portion 1*b* of the housing. Therefore, the housing having the lower friction coefficient ensures that the plunger 3 would not be hindered during the movement. In one example, the housing 1 is made of PTEF material, or the inside of the housing 1 is formed with a PTEF material layer.

In order to facilitate replacement of the plunger 3, the punching mechanism of the present embodiment further includes a connecting joint 7, which is fixed onto the lower part 4*b* of the electromagnetic mechanism and held stationary with respect to the lower part 4*b*, and threaded with the upper end of the plunger 3.

Since a plurality of network nodes are distributed on the surface of the mold insert, in order to move the mold insert, as shown in FIG. 3, the work platform 12 of the present embodiment is installed on the second horizontal guide rail 13, which is arranged perpendicular to the first horizontal guide rail 8. The work platform 12 is capable of horizontally moving along the second horizontal guide rail 13 in a Y axis direction. As used herein, the person skilled in the art should be appreciated that the X axis direction is perpendicular to the Y axis direction.

The work platform 12 is made of permanent magnetic materials, and is used to fix the mold insert by an attractive force therebetween when it is placed on the platform 12. In addition, as shown in FIG. 3, at least two stops 14 are disposed respectively at a square edge where the mold insert is placed on the work platform 12. In the present example, only two stops 14 are shown out, which are used to position the mold insert, so as to avoid a punching deviation caused by the shift occurring in the punching operation. The fixing method as described above is only taken as one example, and of course other conventional fixing means can be also used for the same purpose.

The punching device for punching network nodes on the mold insert of the present embodiment further includes a second driver 31 electrically connected with and controlled by the host driver. The second driver 31 is installed on the second horizontal guide rail 13 and is connected with the work platform 12 by a second driving mechanism 32, so as to drive the work platform 12 to horizontally move along the Y direction on the second horizontal guide rail 13.

In order to automatically adjust the distance between the tool bit 2 and the mold insert, the punching device for punching network nodes on the mold insert of the present embodiment is provided with a vertical guide rail 15 on the mounting seat 9. The housing 1 of the punching mechanism is mounted on the vertical guide rail 15 and is capable of vertically moving along the vertical guide rail 15. Further, a third driver 33 is installed on the mounting seat 9, which is connected with the housing 1 by a third driving mechanism 34, so as to drive the housing 1 to vertically move along the vertical guide rail 15 automatically. In one example, the third driver 33 is electrically connected with the host computer, so as to control the third driver 33 by the host computer.

In order to finely adjust the position of the tool bit 2 in the vertical direction, the housing 1 of the punching mechanism of the present embodiment is vertically installed on the mounting seat 9 by means of a fine adjustment knob 10. Such fine adjustment knob 10 can finely adjust the position of the housing 1 in the vertical direction, that is, the position of the tool bit 2 in the vertical direction, and further adjust the distance between the tool bit 2 and the mold insert on the work platform 12.

The specific working procedure of the punching device for punching network nodes on the mold insert in accordance with one embodiment of the present invention is as follows, in combination with FIGS. 1 and 4.

Step S1—firstly placing the mold insert on the work platform 12, and aligning the square edges of the mold insert with the two stops 14.

Step S2—setting an appropriate value of the electrical current supplied to the electromagnetic mechanism 4 in accordance with the depths of the actual network nodes and the hole diameters thereof.

The host computer firstly controls the first and second drivers 16, 31 so as to horizontally adjust the relative position of the tool bit 2 and the mold insert, so that the tool bit 2 arrives at the position of dotting or performing network node punching operation. Then, the host computer controls the third driver 33 to adjust the height of the tool bit 2, so as to coarsely adjust the distance between the tool bit 2 and the mold insert. Finally, the fine adjustment knob 10 is used to finely adjust the distance between the tool bit 2 and the mold insert. In accordance with a relationship of the current value of the electromagnetic mechanism with the distance between the tool bit and the mold insert, it is possible to find out a suitable value of the electrical current supplied to the electromagnetic mechanism 4 by measuring the distance between the tool bit 2 and the mold insert.

Step S3—starting the punching mechanism, and sending the predetermined value of the electrical current to the electromagnetic mechanism 4 by the host computer, so that the electromagnetic mechanism 4 generates a corresponding repulsive force, and under the action of such repulsive force, the plunger 3 is pushed and in turn the tool bit 2 is pushed so as to perform the dotting operation or the network node punching operation.

Step S4—performing triangulation by means of the laser distance meter 11 during the dotting, measuring the flatness of the mold insert, the spacing between the network nodes, the depths of the network nodes and the hole diameters of the network nodes, and sending them to the displacement operation controller; and confirming measurement results from the laser distance meter 11 via the displacement operation controller and converting them, so as to determine whether to adjust the value of the electrical current supplied to the electromagnetic mechanism 4.

It should be understood that when the surface of the mold insert is sufficiently flat or the flatness thereof complies with the relevant requirement (i.e., within the acceptable tolerance range), it is not necessary to adjust the electrical current value of the electromagnetic mechanism 4; and when the surface of the mold insert is not flat or the flatness thereof does not comply with the relevant requirement, the displacement operation controller calculates a tolerance value of the displacement and converts it into a tolerance value of the electrical current, and the host computer increases or decreases the current value of the electromagnetic mechanism 4 in response to the tolerance value of the electrical current, so as to ensure the depths and the hole diameters of the network nodes on the whole mold insert to be consistent with each other, and the uniformity of the network nodes on the whole mold insert may be acquired.

During the dotting, since the surface of the mold insert cannot be absolutely flat, when a height difference is detected between the current distance between the mold insert and the tool bit and an initial distance between the mold insert and the tool bit, the electrical current value of the electromagnetic mechanism should be adjusted accordingly. If the detected height difference is positive, then it indicates the distance between the mold insert and the tool bit is larger than the initial distance, and it is necessary to increase the electrical current value of the electromagnetic mechanism 4. Otherwise, when the detected height difference is negative, the electrical current value of the electromagnetic mechanism 4 shall be reduced.

Step S5—during the punching process of the network nodes on the mold insert, controlling the first driver 16 by the host computer so as to drive the mounting seat 9 and horizontally move it along the first horizontal guide rail in the X axis direction, so that the tool bit 2 horizontally moves in the X axis direction; and controlling the second driver 31 by the host computer so as to drive the work platform 12 and horizontally move it along the second horizontal guide rail 13 in the Y axis direction, so that the work platform 12 horizontally moves in the Y axis direction, thereby performing the punching operations of the plurality of network nodes on the surface of the mold insert.

Concerning the above, the punching device for punching network nodes on the mold insert of embodiments of the present invention utilizes the laser distance meter to accurately measure the depths and the hole diameters of the network nodes, the flatness of the surface of the mold insert and the spacing between the network nodes in real-time. Therefore, it is capable of adjusting in real-time the punching force of the network nodes of the punching mechanism and the moving position thereof during the punching process, thereby achieving the accurate control of the hole diameters, the depths and the uniformity of the network nodes. Further, the tolerances of the depths and the hole diameters of the network nodes can be reduced, and the yield of the light guide plate can be improved. Further, the electromagnetic mechanism is served as the drive mechanism for punching the network nodes on the mold insert. During the punching operation, the voltage of the power source can be adjusted as needed and depending on the actual conditions, and then the magnetic force of the electromagnetic mechanism can be adjusted, thereby improving the controllability of the whole punching mechanism and improving the punching accuracy. The punching device of embodiments of the present invention has a high automation on the whole, may reduce artificial error and improve the working efficiency.

Although several exemplary embodiments have been shown and described, the present invention is not limited to those and it would be appreciated by those skilled in the art that various changes or modifications may be made in these embodiments without departing from the principles and spirit of the disclosure. These changes or modifications also fall within the scope of the present invention. The scope of the present invention is defined by the claims and their equivalents.

What is claimed is:

1. A punching device for punching network nodes on a mold insert, comprising:

a first horizontal guide rail;

a mounting seat, installed on the first horizontal guide rail and horizontally movable along the first horizontal guide rail;

a first driver, installed on the first horizontal guide rail and connected with the mounting seat by a first driving mechanism;

a punching mechanism, installed on the mounting seat;

a laser distance meter, installed on the mounting seat;

a host computer, electrically connected with both the punching mechanism and the first driver;

a displacement operation controller, communicated with both the laser distance meter and the host computer; and a work platform, configured to carry the mold insert and located beneath the punching mechanism, wherein the laser distance meter is configured to measure depth of the network nodes, hole diameters of the network nodes, spacing between the network nodes, and flatness of the mold insert, and the displacement operation controller derives an appropriate value of electrical current from measurement results of the laser distance meter and sends the value of electrical current to the host computer, and the host computer supplies electricity to the punching mechanism in accordance with the value of electrical current so as to perform an operation of punching the network nodes on the mold insert.

2. The punching device according to claim 1, wherein the punching mechanism comprises:

a housing, fixedly installed on the mounting seat; and a tool bit, a plunger, a return spring and an electromagnetic mechanism in turn disposed within an interior of the housing, wherein the electromagnetic mechanism is electrically connected with the host computer configured to control on/off and magnetic force of the electromagnetic mechanism, and the electromagnetic mechanism is connected with an upper end of the plunger for applying a pushing force onto the plunger, wherein the return spring is fitted over an exterior of the plunger, an upper end of the return spring is fixed at a position of the upper end of the plunger, and a lower end of the return spring is abutted against a lower part of the housing, wherein a lower end of the plunger is connected with the tool bit.

3. The punching device according to claim 2, wherein the electromagnetic mechanism comprises an upper part of the electromagnetic mechanism and a lower part of the electromagnetic mechanism, wherein the upper part of the electromagnetic mechanism is electrically connected with the host computer, and the lower part of the electromagnetic mechanism is connected with the upper end of the plunger, wherein the upper part and lower part of the electromagnetic mechanism each is made of an electromagnet and windings wound around an exterior of the electromagnet, when being energized, a repulsive force is generated between the upper part and the lower part of the electromagnetic mechanism to push the plunger and further to downwardly push the tool bit so as to punch the mold insert for forming desired network nodes.

4. The punching device according to claim 3, wherein the punching mechanism further comprises a connecting joint, which is fixed at the lower part of the electromagnetic mechanism, and is threaded with the upper end of the plunger.

5. The punching device according to claim 2, wherein the housing is made of diamagnetic material having low friction coefficient.

6. The punching device according to claim 5, wherein the housing is made of PTEF or a PTEF material layer is formed on an inside of the housing.

7. The punching device according to claim 2, wherein the housing comprises an upper portion and a lower portion, and the upper portion has a larger diameter than that of the lower portion.

8. The punching device according to claim 1, wherein the punching mechanism is vertically installed on the mounting seat by a fine adjustment knob.

9. The punching device according to claim 1, wherein the punching device further comprises a second driver and a second horizontal guide rail disposed perpendicular to the first horizontal guide rail, wherein the work platform is installed on the second horizontal guide rail and horizontally movable along the second horizontal guide rail, and the second driver is electrically connected with the host computer, wherein the second driver is installed on the second horizontal guide rail and connected with the work platform by a second driving mechanism.

10. The punching device according to claim 9, wherein the punching device further comprises a third driver provided on the mounting seat and a vertical guide rail, and wherein the punching mechanism is installed on the vertical guide rail and vertically movable along the vertical guide rail, wherein the third driver is electrically connected with the host computer and connected with the punching mechanism by a third driving mechanism.

11. The punching device according to claim 1, wherein the work platform is made of permanent magnet material.

12. The punching device according to claim 1, wherein at least two stops are respectively provided at a square edge where the mold insert is placed on the work platform, for positioning the mold insert.

13. The punching device according to claim 1, wherein the tool bit is a diamond bit.

14. A method of punching network nodes on a mold insert, comprising the following steps:

S0: providing a punching device according to claim 10;

S1: placing the mold insert on the work platform of the punching device;

S2: setting a value of electrical current supplied to an electromagnetic mechanism within the punching mechanism of the punching device in accordance with depths of the network nodes and hole diameters thereof;

S3: starting the punching mechanism, and sending the set value of the electrical current to the electromagnetic mechanism by the host computer of the punching device, so that the electromagnetic mechanism generates a corresponding repulsive force, and under the action of such repulsive force, a plunger within the punching mechanism is pushed and in turn it pushes a tool bit so as to perform a network node punching operation;

S4: performing measurement by means of the laser distance meter of the punching device during the network node punching operation, and using the displacement operation controller of the punching device to calculate a tolerance value of displacement from measurement results of the laser distance meter and converting it into a tolerance value of the electrical current, and adjusting a value of the electrical current supplied to the electromagnetic mechanism by means of the host computer in accordance with the tolerance value of the electrical current; and S5: during the punching process of the network nodes on the mold insert, controlling the first driver by the host computer so as to drive the mounting seat of the punching device and horizontally move it along the first horizontal guide rail of the punching device in a first direction, so that the tool bit horizontally moves in the first direction; and controlling the second driver of the punching device so as to drive the work platform and horizontally move it along the second horizontal guide rail of the punching device in a second direction perpendicular to the first direction, so that the mold insert horizontally moves in the second direction, thereby performing the punching operations of the plurality of network nodes on the surface of the mold insert.

15. The method according to claim 14, wherein in the step S1, further comprising the step of:

aligning square edges of the mold insert with at least two stops provided on the work platform respectively, so as to position the mold insert.

16. The method according to claim 14, wherein in the step S2, further comprising the step of:

setting the value of the electrical current of the electromagnetic mechanism by measuring a distance between the tool bit and the mold insert, in accordance with a relationship of the value of the electrical current of the electromagnetic mechanism within the punching mechanism and distances between the tool bit and the mold insert.

17. The method according to claim 16, wherein in the step S2, further comprising the step of:

controlling the first driver and the second driver by the host computer so as to horizontally adjust a relative position of the tool bit and the mold insert, so that the tool bit is able to perform a dotting operation at a desired position of the mold insert;

controlling the third driver by the host computer, so as to coarsely adjust the distance between the tool bit and the mold insert;

finely adjusting the distance between the tool bit and the mold insert by a fine adjustment knob.

18. The method according to claim 14, wherein in the step S4, further comprising the step of:

during the punching process of the network nodes, performing triangulation with the laser distance meter, measuring the flatness of the mold insert, spacing between the network nodes, and depths and hole diameters of the network node, and sending them to the displacement operation controller; and confirming measurement results via the displacement operation controller and converting them, so as to determine whether to adjust the value of the electrical current supplied to the electromagnetic mechanism:

when it is found that the flatness of the surface of the mold insert complies with requirements after confirmation and conversion, it is not necessary to adjust the value of the electrical current supplied to the electromagnetic mechanism;

when it is found that the flatness of the surface of the mold insert does not comply with requirements after confirmation and conversion, the displacement operation controller calculates the tolerance value of displacement and converts it into the tolerance value of the electrical current, and the value of the electrical current supplied to the electromagnetic mechanism is increased or decreased by the host computer in accordance with the tolerance value of the electrical current.

19. The method according to claim 18, wherein when a height difference is detected between a current distance between the mold insert and the tool bit, and an initial distance between the mold insert and the tool bit, adjusting the value of the electrical current of the electromagnetic mechanism:

when the detected height difference is positive, increasing the value of electrical current supplied to the electromagnetic mechanism;

when the detected height difference is negative, decreasing the value of electrical current supplied to the electromagnetic mechanism.

* * * * *